United States Patent [19]

Cairns et al.

[11] 3,937,545

[45] Feb. 10, 1976

[54] WATERPROOF ELECTRICAL CONNECTOR

[75] Inventors: Thomas M. Cairns, Birmingham, Mich.; Ronald F. Froats, Windsor,, Canada

[73] Assignee: Ford Motor Company, Dearborn, Mich.

[22] Filed: Dec. 23, 1974

[21] Appl. No.: 535,924

[52] U.S. Cl. ..... 339/60 R
[51] Int. Cl.[2] ..... H01R 13/52
[58] Field of Search ..... 339/59–61, 339/94

[56] References Cited

UNITED STATES PATENTS

| | | | |
|---|---|---|---|
| 3,601,760 | 8/1971 | Cairns | 339/59 M |
| 3,686,619 | 8/1972 | McCardell, Jr. et al. | 339/59 M |
| 3,792,416 | 2/1974 | Moulin | 339/94 R |
| R28,126 | 8/1974 | Poingt | 339/59 R |

*Primary Examiner*—Joseph H. McGlynn
*Attorney, Agent, or Firm*—John J. Roethel; Keith L. Zerschling

[57] ABSTRACT

A separable waterproof electrical connector for a plurality of pairs of axially interconnectable cylindrical electrical terminals coupled to the ends of insulated wires, each terminal having an annular external recess in its cylindrical peripheral surface.

The connector comprises a pair of elongated, rigid, non-conductive elastomeric, tubular members having generally complementary end portions fitted one into the other. A soft elastomeric sealing sleeve is concentrically interposed between the interengaged end portions to prevent the passage of moisture therebetween. Releasable clamping means on the exterior of the tubular member end portion hold the latter in engagement.

Each elastomeric tubular member has an interior partition wall extending laterally of its longitudinal axis in juxtaposition to the interengaged end portions. Each partition wall has a plurality of axially extending apertures therethrough that are equally spaced around the longitudinal axis of the tubular members. The electrical terminals are seated in the apertures.

A portion of the wall of each aperture comprises an axially extending cantilevered locking member hinged at one end to the partition wall and having a detent spaced from its hinged end. The detent is adapted to engage the external recess on the terminal seated in a respective aperture to prevent axial displacement of the latter. Each partition wall has an axially extending cavity communicating with the locking members. A displaceable plug means is seated in the partition cavity in abutting relation to the locking member to hold the detents on the latter in the respective terminal recesses.

A grommet is seated in the tubular member outwardly of the partition wall through which the insulated wires extend. The grommets are in sealing engagement with the interior walls of the tubular members and the insulated wires in watertight relation.

5 Claims, 7 Drawing Figures

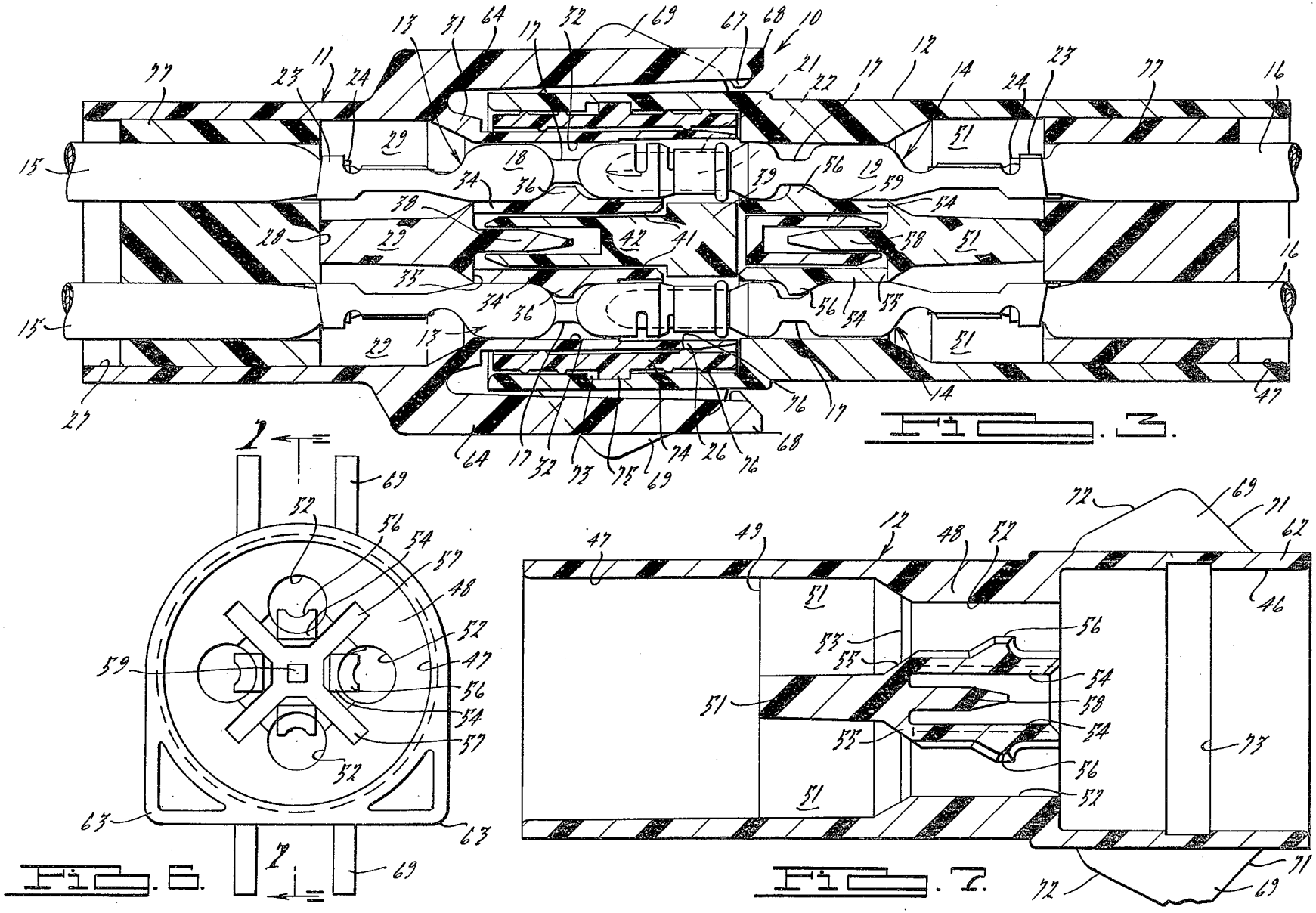

WATERPROOF ELECTRICAL CONNECTOR

BACKGROUND OF THE INVENTION

The need for completely waterproof electrical connectors, particularly in automobiles, is the result of the recent trend towards the use of electronic circuitry which requires high insulation resistance between individual circuits. In the past, electrical connectors have been used with various degrees of dust proofing, splash proofing and waterproofing. The earlier designs were primarily for protection against corrosion of the electrical terminals which could cause failure in a somewhat long term. With the advent of electronic circuits in the automobile in more recent years, it has become imperative to insure that no conductive fluid, such as salt water, forms a conductive circuit between adjacent terminals within the connector body. The ingress of conductive fluid from road splash, for example, into a connector containing high impedance circuits, can cause immediate catastrophic failure of a system such as a breakerless ignition system.

It is an object of the present invention to provide a completely waterproof electrical connector. The improved connector embodying the present invention is adapted to use electrical terminals of the type shown in U.S. Pat. No. 3,482,207 issued Dec. 2, 1969 to T. M. Cairns entitled "Electrical Terminal". The improved connector has antecedents in the electrical connector disclosed in U.S. Pat. No. 3,601,760 issued Aug. 24, 1971 to T. M. Cairns for "Electrical Connector".

SUMMARY OF THE INVENTION

The present invention relates to a separable waterproof electrical connector for holding and insulating a plurality of pairs of axially interconnectable cylindrical electrical terminals coupled to the ends of insulated wires, each terminal having an annular external recess in a cylindrical peripheral surface.

The connector comprises a pair of elongated, rigid, non-conductive elastomeric, tubular members having generally complementary end portions fitted one into the other. A soft elastomeric sealing sleeve is concentrically interposed between the interengaged end portions to prevent the passage of moisture therebetween. Releasable clamping means on the exterior of the tubular member end portions holds the latter in engagement with each other.

Each elastomeric tubular member has an interior partition wall extending laterally of its longitudinal axis in juxtaposition to the interengaged end portions. Each partition wall has a plurality of axially extending apertures therethrough equally spaced around the longitudinal axis of the tubular members. The electrical terminals are seated in the axially extending apertures.

A portion of the wall of each aperture comprises an axially extending cantilevered locking member hinged at one end to the partition wall and having a detent spaced from is hinged end engaged with the external recess on the terminal seated in the respective aperture to prevent axial displacement of the terminal relative to the aperture in which it is seated. Each partition wall has an axially extending cavity communicating with the locking members. A displaceable plug means is seated in the partition cavity in abutting relation to the locking members to hold the detents on the latter in the respective terminal recess.

A grommet means is seated in the tubular member outwardly of the partition wall through which the insulated wires extend. The grommet means is in watertight engagement with the interior walls of the tubular members and the insulated wires passing through the grommet means.

DESCRIPTION OF THE DRAWINGS

Further features and advantages of the present invention will be made more apparent as this description proceeds, reference being had to the accompanying drawings wherein:

FIG. 3 is a vertical section of the connector assembly;

FIG. 6 is an end elevation of the female connector of the connector assembly; and FIG. 7 is a section view on the line 7—7 of FIG. 6.

DETAILED DESCRIPTION OF THE INVENTION

Figure 1:
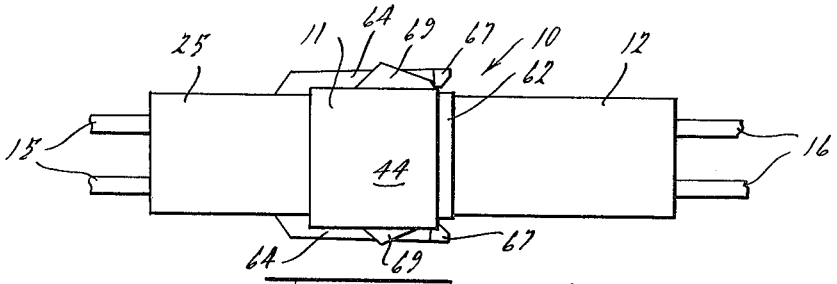
FIG. 1 is a side elevation of a complete connector assembly embodying the present invention.
Figure 2:
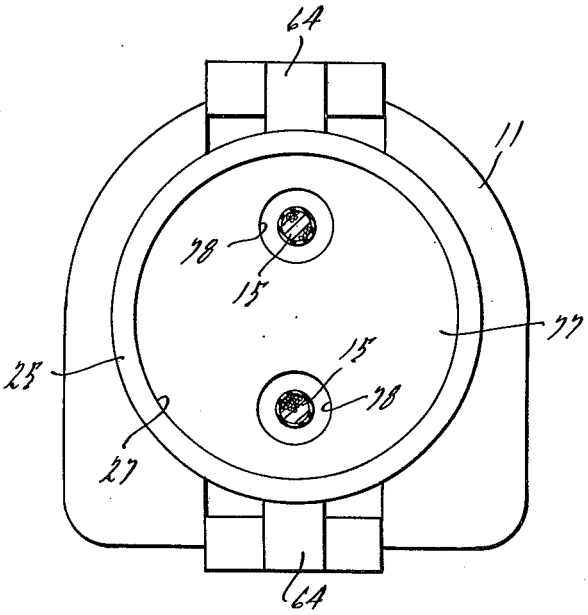
FIG. 2 is an end elevation of the connector assembly taken from the left end as viewed in FIG. 1.

Referring now to the drawings, there is shown a connector assembly generally designated 10. The connector assembly 10 comprises a male connector or connector block 11 having interfitting engagement with a female connector or connector block 12. As will be more fully described, the connector block 11 and 12 are adapted to receive a plurality of pairs of terminals 13 and 14 (see FIG. 3) coupled to the ends of insulated wires 15–16, respectively. Each terminal has an annular external recess 17 on its cylindrical peripheral surface 18–19.

In FIG. 3, the terminal 13 is shown axially interconnected with the terminal 14. The terminal 13 having an axially extending cavity 21 receiving the pointed end 22 of the terminal 14. The opposite ends 23 of the terminals are crimped to the conductors 24 within the insulation of the insulating wires 15–16.

Although there are some differences in size and proportions, the terminals 13–14 in design and function are substantially similar to the male and female terminals disclosed in U.S. Pat. No. 3,482,207 and reference is made to that patent for further details of construction.

The connector block 11–12 comprising the connector assembly 10 are generally elongated, rigid, nonconductive elastomeric tubular members. The details of the connector block 11 will be described with reference to FIGS. 4 and 5.

Figure 5:
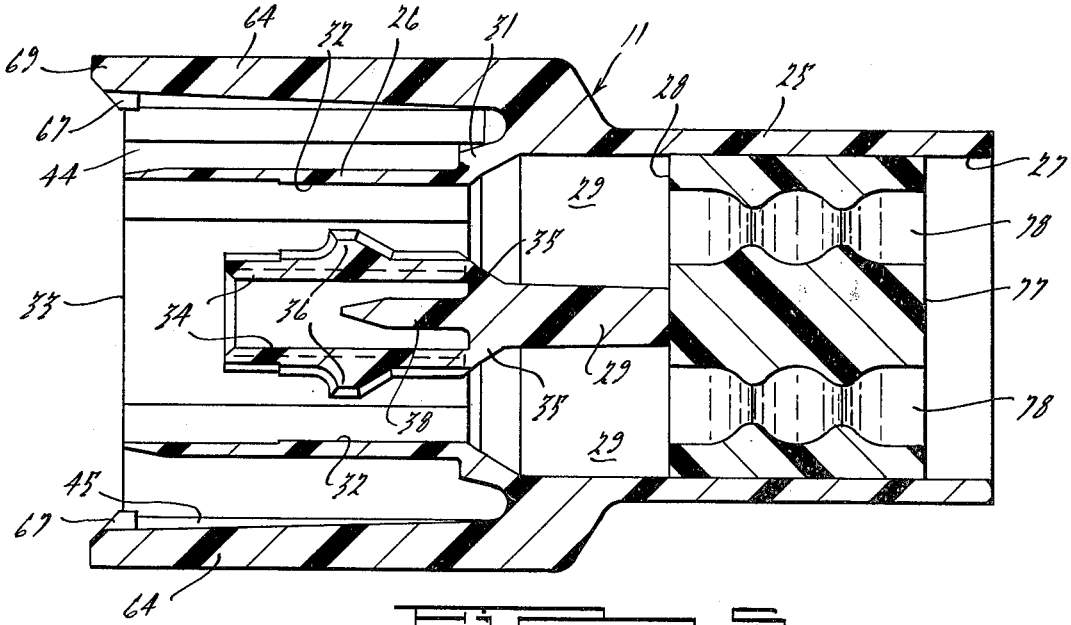
FIG. 5 is a vertical sectional view on the line 5—5 of FIG. 4.

The connector block 11 has a generally cylindrical stepped body as indicated at 25 and 26, the body portion 25 comprising substantially the right half of the connector block as viewed in FIG. 5 and the body portion 26 the left half. The body portion 25 has a cylindrical cavity 27 extending to a depth indicated by the line 28 beyond which the cavity is partitioned by axially extending crossed ribs 29 to the depth of a partition wall 31 separating the body into its two half portions 25–26.

The body portion 26 has a plurality of axially extending apertures 32, in the preferred embodiment shown as four. The apertures 32 extend from the outer edge 33 of the body portion 26 through the partition wall 31.

The apertures 32 are only a full circle where they go through the partition wall 31. To the left of the partition wall, as viewed in FIG. 5, the apertures 31 are more in the nature of semicylindrical recesses open toward the center of the connector block 11. As best seen in FIG. 3, the apertures 31 provide a retention seat for the terminals 13. A portion of the wall of each aperture 31 on its open side is formed by an axially extending cantilevered locking member 34. Each locking member 34 is integrally hinged at 35 to the partition wall 31 and extends axially outwardly toward the open end of the body portion 26. Intermediate the ends of each locking member 34 the latter is provided with an upstanding detent 36. The detent 36 is adapted to snap into the recess 17 on the terminal 13, for a purpose to be explained.

Figure 4:
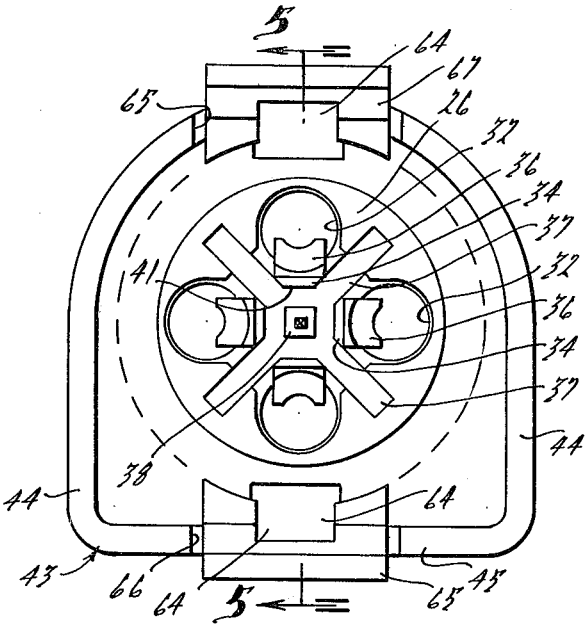
FIG. 4 is an end elevation of the male connector of the connector assembly.

As best seen in FIG. 4, between the apertures 31 and the locking members 34 the body portion 26 is provided with axially extending slots 37, the slots intersecting at the center of the connector block 11.

A square peg 38 projects axially from the partition wall 31 toward the open end 33 of the body portion 26 at the intersection of the slots 32. The square peg 38 is adapted to act as a pilot to receive a finned removable plug 39. The fins (not visible) on the plug 39 are complementary to the cross slots 37 and are slidably therein. When the plug 39 is in position (see FIG. 3), the base 41 of each locking member 34 abuts the central body portion 42 of the plug 39. The locking member is thus held against flexure in a direction to permit disengagement of the locking member detent 36 from the terminal recess 17.

The body portion 26 of the connector block 11 is surrounded by a shell 43 having side walls 44 and a base wall 45. The side walls 44 are curved to form an arch over the body portion 26, see FIG. 4.

Reference is now made to FIGS. 6 and 7 for the details of construction of the connector block 12. The connector block 12 also is substantially tubular in shape and has a cylindrical cavity extending inwardly of each end, that is, a cavity 46 extending inwardly from the right end as viewed in FIG. 7 and a cavity 47 extending inwardly from the left end. The cavities are separated by a relatively thick partition wall 48.

The cavity 47 extends uninterruptedly to a depth indicated by the line 49. Toward the partition 48 the cavity is axially partitioned by axially extending cross ribs 51. The cavities 46–47 are in communication through a plurality of axially extending apertures 52 corresponding in number and position with the apertures 32 in the connector block 11. The apertures are a full circle only where they penetrate the end 53 of the partition wall 48. For a substantial part of their length they form semi-cylindrical recesses open toward the center of the connector block 12. The apertures 52 provide a retention seat for the terminals 14, see FIG. 3. As in the case of the connector block 12, a portion of each wall of the retention aperture 52 is formed by an axially extending cantilevered locking member 54. Each locking member 54 is integrally hinged at 55 to the partition wall 48 and extends axially outwardy toward the cavity 46 and the connector block 12. Intermediate its ends each locking member 54 is provided with an upstanding detent 56.

The detents 56 correspond to the detents 36 of the locking member 35 of the previously described connector block 11. Each detent 56 is adapted to engage a recess 17 in the terminal 14, see FIG. 3.

As best seen in FIG. 6, between the apertures 51 and the locking members 54, the partition wall 53 is provided with slots 57, the slots intersecting at the center of the connector block 12. A square peg 58 projects into the center of the slots 57 to function as a pilot for a removable plug 59, similar to the plug 39 used with the connector block 11. The fins of the plug 59 (not visible) are complementary to the cross slots 57. When the plug is in position (see FIG. 3), the base 61 of each locking member 54 is abutted by the central body portion 62 of the plug. The locking member is thus held against flexing in a direction to permit disengagement of the locking member detent 56 from the terminal recess 17.

The right end 62 of the connector block 12 is squared off at its lower corner 63. The right end 62 of the connector block 12 is complementary in shape to the left end of the connector block 11 as viewed in FIG. 4 and is adapted to telescopically fit into the latter, as seen in FIG. 3. Because of the shape of the telescoping end portions of the connector blocks 11 and 12, they can only be fitted together in one relative position whereby they act as a pilot insuring alignment of the respective pairs of terminals 13–14 in a predetermined relationship.

A pair of releasable clamp devices are utilized to hold the connector blocks 11–12 in engagement as shown in FIGS. 1 and 3. Each clamp device comprises an axially extending finger-like member 64 hinged at 65 to the connector block 11 at diametrically opposite sides of the latter. The sides to which the member 64 are hinged are slotted at 65 and 66, respectively, with each member 64 extending the length of its adjacent slot. Each member 64 has a lateral wing or extension 67 of somewhat greater width at its distal end 68.

The connector block 12 on its upper and lower external surfaces at its end 62 has keeper devices 69. Each keeper device 69 comprises a pair of spaced upstanding ribs having inclined ramp surfaces 71 and 72 at its respective leading and trailing edges.

When the two connector blocks 11–12 are telescopically assembled, see FIG. 3, the distal end 68 of each clamping member 64 rides up the ramp 71 on the keeper device 69 and snaps over the latter thereby yieldingly holding the connector blocks in assembled relationship. To disassemble the connector blocks, sufficient axial pressure in a separation direction must be applied to pull the connector blocks apart. The distal ends 68 of the clamping members 64 are adapted to ride up the reverse slope ramp 72 on the keeper ribs 69 in response to such axial pressure.

An important feature of the present invention is the sealing of the chambers in which the terminals 13 and 14 are housed when in assembled relation. With reference to FIG. 7, it will be noted that the cavity 46 in the connector block 12 has an internal recess 73 in is wall. This recess 73 is a retention device which concentrically positions and holds an elastomeric sealing sleeve 74 (see FIG. 3). The sleeve 74 has an external rib 75 which in assembled position fits within the recess 73. The sleeve 74 also has a plurality of internal and external peripheral rings 76. When the body portion 26 of the connector block 11 is forced into the sleeve 74 after the latter is positioned in the cavity 46 of the connector block 12, the rings 76 functions as O-rings under compression and prevent flow of fluids into the interior of the connector blocks 11 and 12 from the telescopic portions thereof.

The connector blocks 11 ans 12 are further sealed at each end by grommets 77. The configuration of the grommets is best seen in FIG. 5. Each grommet is a soft elastomeric material of cylindrical shape and has a plurality of hour glass apertures 78 extending axially. The number of apertures depends upon the number of pairs of terminals to be used and in the present disclosure is shown as two. The aperture 78 yieldably receive the insulated wires 15–16 with a water-tight grip. The grommets 77 are positioned at the bottom of the respective cavities 27 in connector block 11 and 47 in connector block 12. That is, they are inserted in the cavities as far as they can be until they abut the respective ribs 29 and 51 at the bottom of the cavities. The assembly of the connector blocks 11–12 and the insulated wires 15-16 involves the following: The grommets 77 must be slipped over the terminal ends 13–14 of the pairs 15 or 16 of the insulated wires. The sealing sleeve 74 must be positioned within the cavity 46 in the connector block 12. The terminals 13 and 14 on the respective pairs of insulated wires 15–16 must then be inserted into the connector blocks 11–12.

To arrive at the relationship shown in FIG. 3, the terminals 13 are inserted into the cavity 27 of the connector block 11 and aligned with the vertical apertures 32. The terminals 13 are then forced into the apertures to a depth which is signaled by the detent 36 on the locking member 34 snapping into the recess 17 on the terminal body 18. The grommet 47 is then forced into the cavity 27 to a depth at which it abuts the ribs 29.

Similarly, the terminals 14 are inserted into the aperture 52 of the connector block 12 through the cavity 47 end of the latter. The detents 56 on the locking members 54 signal when the proper position of the terminals 14 is reached in the connector block. Again, the grommet 77 is positioned within the cavity 47 to seal the latter.

The two connector blocks are now ready for final assembly. The tip or pointed ends 21 of the terminals 14 project a substantial distance ahead of the partition wall 48 of the connector block 12. The ends of the terminals 13 are substantially flush with the end or outer edge 33 of the body portion 26 of the connector block 11.

The assembly of the connector blocks 11–12 involves the alignment and insertion of the end 62 of the connector block 12 into the connector block shell 43, the body portion 26 of the connector block 11 into the sealing sleeve 74 in the cavity 46 and connector block 12, and the terminal 14 pointed end 22 into receiving cavity 21 on the terminal 13. With these parts in axial alignment, the connector blocks are moved axially relatively to one another sufficiently to have the external clampong members 64 and 68 ride up and over the ramp 71 on the keeper devices 69 to yieldably lock the connector blocks 11 and 12 together.

The connector blocks may be disassembled by the application of axial force in a direction to pull them apart. The force that has to be applied is much grater than would be encountered under normal operating conditions, e.g., such as vibratory forces acting on the connector.

It is to be understood this invention is not limited to the exact construction illustrated and described above, but that various changes and modifications may be made without departing from the spirit and scope of the invention as defined by the following claims.

We claim:

1. A separable waterproof electrical connector for a plurality of pairs of axially interconnectable cylindrical electrical terminals coupled to the ends of insulated wires, each terminal having an annular external recess in its cylindrical peripheral surface, the connector comprising:

a pair of elongated, rigid nonconductive elastomeric, tubular members having generally complementary end portions, fitted one into the other, a soft elastomeric sealing sleeve concentrically interposed between the interengaged end portions to prevent the passage of moisture therebetween, the soft elastomeric sleeve having an external retention ring engageable with a groove in one of the tubular members to hold the sleeve in place in the one member upon axial separation of the tubular members, and a plurality of internal and external integral circumferential sealing rings on the sleeve compressible between the abutting tubular member surfaces, releasable clamping means on the exterior of the tubular member end portions holding the latter in engagement, each elastomeric tubular member having an interior partition wall extending laterally of its longitudinally axis in juxtaposition to the interengaged end portions thereof, each partition wall having a plurality of axially extending apertures therethrough equally spaced around the longitudinal axis of the tubular members, the electrical terminals being seated in the apertures, a portion of the wall of each aperture comprising an axially extending cantilevered locking member hinged at one end to the partition wall and having a detent spaced from its hinged end engaged with the external recess on the terminal seated in the respective aperture to prevent axial displacement of the terminal, each partition wall having an axially extending cavity communicating with the locking members, displaceable plug means seated in the partition cavity in abutting relation to the locking members to hold the detents on the latter in the respective terminal recesses, and grommet means seated in the tubular member outwardly of the partition wall through which the insulated wires extend, the grommet means being in watertight engagement with the interior walls of the tubular members and the insulated wires.

2. A separable waterproof electrical connector according to claim 1, in which:

the releasable clamping means comprises at least a pair of diametrically opposite cantilevered locking levers extending axially exteriorly on one of the tubular members, the distal ends of the levers being engageable with cam means on the exterior surface of the other of the tubular members.

3. A separable waterproof electrical connector according to claim 2, in which:

the grommet means has internal integral sealing ribs gripping the insulation of the insulated wires.

4. A separable waterproof electrical connector according to claim 3, in which:

the partition wall cavity comprises a plurality of slots intersecting at the tubular member axis, the slots being equal in number to the apertures, and the displacement plug means has locating fins received within the slots with body portions between the fins in abutting engagement with the locking members to prevent flexure in a direction transversely of the tubular member axis.

5. A separable waterproof electrical connector for a plurality of pairs of axially interconnectable cylindrical electrical terminals coupled to the ends of insulated wires, each terminal having an annular external recess in its cylindrical peripheral surface, the connector comprising:

a pair of elongated, rigid nonconductive elastomeric, tubular members having generally complementary end portions, fitted one into the other, a soft elastomeric sealing sleeve concentrically interposed between the interengaged end portions to prevent the passage of moisture therebetween, releasable clamping means on the exterior of the tubular member end portions holding the latter in engagement, each elastomeric tubular member having an interior partition wall extending laterally of its longitudinally axis in juxtaposition to the interengaged end portions thereof, each partition wall having a plurality of axially extending apertures therethrough equally spaced around the longitudinal axis of the tubular members, the electrical terminals being seated in the apertures, a portion of the wall of each aperture comprising an axially extending cantilevered locking member hinged at one end to the partition wall and having a detent spaced from its hinged end engaged with the external recess on the terminal seated in the respective aperture to prevent axial displacement of the terminal, each partition wall having an axially extending cavity communicating with the locking members, the partition wall cavity comprising a plurality of slots intersecting at the tubular member axis, the slots being equal in number to the apertures, displaceable plug means seated in the partition cavity in abutting relation to the locking members to hold the detents on the latter in the respective terminal recesses, the displaceable plug means having locating fins received within the slots with body portions between the fins in abutting engagement with the locking members to prevent flexure of the latter in a direction transversely of the tubular member axis, and grommet means seated in the tubular member outwardly of the partition wall through which the insulated wires extend, the grommet means being in watertight engagement with the interior walls of the tubular members and the insulated wires.

* * * * *